United States Patent [19]

Satake

[11] 4,133,257

[45] Jan. 9, 1979

[54] RICE PEARLING APPARATUS WITH HUMIDIFIER

[76] Inventor: Toshihiko Satake, 2-38, Saijonishihonmachi, Higashihiroshima, Japan

[21] Appl. No.: 769,468

[22] Filed: Feb. 17, 1977

[30] Foreign Application Priority Data

Mar. 2, 1976 [JP] Japan ..... 51/22424

[51] Int. Cl.[2] ..... B02B 1/04; B02B 3/00

[52] U.S. Cl. ..... 99/518; 99/613

[58] Field of Search ..... 99/518–528, 99/235 R, 235 A, 236 C, 484, 536, 600–608, 612–614

[56] References Cited

U.S. PATENT DOCUMENTS

| | | | |
|---|---|---|---|
| 707,057 | 8/1902 | Gaff et al. | 99/613 |
| 2,340,313 | 2/1944 | Earle | 99/521 |
| 3,552,465 | 1/1971 | Asper et al. | 99/522 |
| 3,675,697 | 7/1972 | Muller | 99/536 |
| 3,766,847 | 10/1973 | Palyi | 99/518 |

*Primary Examiner*—Leonard D. Christian
*Attorney, Agent, or Firm*—Jay L. Chaskin

[57] ABSTRACT

A rice pearling apparatus with a humidifier includes a humidifying section comprising a humidifying line open into an essential part of one of pearling chambers in a series of pearling units, and perforated walls for debranning-pearling cylinders provided in the pearling units before and after the humidifying section. The quotient of the total perforated wall surface area of the frictional pearling chambers after the humidifying section divided by the product of the pearling ratio multiplied by the rise flow rate is not less than one time as much as the quotient of the total perforated wall surface area of the frictional pearling chambers before the humidifying section divided by the same product as above.

6 Claims, 2 Drawing Figures

RICE PEARLING APPARATUS WITH HUMIDIFIER

This invention relates to improvements in a rice pearling apparatus.

The apparatus according to the invention has been developed with the view to obtaining fine, glossy polished or pearled rice by properly choosing the point for humidifying the grains during the polishing or pearling process and by providing pearling cylinders having an adequate bran-separating area for use after the humidification.

For the purpose of the invention the term "pearling ratio" is herein used to mean the ratio of the weight of brown rice lost on pearling, or the weight of bran collected as a by-product, to the original weight of the brown rice. Hence it may be expressed by the formula $$1 - \frac{\text{weight of a grain of pearled rice}}{\text{weight of a grain of brown rice}}$$

For example, the pearling ratio of white rice obtained in a yield of 94% from brown rice is 1–0.94 = 0.06, or 6%. The loss of the moisture content upon pearling is neglected in this calculation.

The flow rate of rice grains at a given point of the pearling process is directly proportional to the yield at that point. Thus, the average flow rate of the rice grains in a pearling ratio ranging from 0 to 6% may be relatively expressed as $(100 + 94)/2 = 97\%$, and that of the rice in a pearling ratio from 6 to 10% as $(94 + 90)/2 = 92\%$.

Accordingly, during pearling operation up to the pearling ratio of 6%, the average "product of the pearling ratio multiplied by the rice flow rate" may be relatively expressed as $6 \times 97 = 582$, and for a pearling ratio in the range between 6 and 10% as $4 \times 92 = 368$.

Now if it is assumed that the total surface area of perforated debranning cylinders for the rice in a pearling ratio up to 6% is 300 and that for the rice in a pearling ratio of greater than 6% is 200, then the "quotient of the total surface area of the perforated debranning cylinders divided by the product of the pearling ratio multiplied by the rice flow rate" is relatively expressed as $300 \div 582 = 0.515$ for the former and as $200 \div 368 = 0.543$ for the latter. This means that the latter value is $0.543 \div 0.515 = 1.05$ times as much as the former.

The water to be fed to the humidifying section in accordance with the invention to be described later may take the form of an aqueous solution, humidified air, or steam, which may be heated before use, when necessary.

Generally, pearling white rice for cooking to a yield of approximately 90%, or to a pearling ratio of approximately 10%, will expose the hard inner portions of the rice grains, which in turn will rapidly reduce the efficiency and retard the progress of pearling operation. Above all, complete removal of aleulum layer in the longitudinally grooved portions of depressed rice grains from the grains have been considered next to impossible. As a result, the rice obtained is soiled with fine bran powder carried on the grain surface which must be washed away before cooking.

According to the present invention, the rice smoothened on the surface by pearling to a ratio of more than about 6%, primarily in frictional pearling chambers surrounded by perforated debranning-pearling cylinders, is humidified and then is additionally processed in frictional pearling chambers with perforated cylinders. The rice is subjected in the latter chambers to milling, debranning, dehydrating, and polishing actions combinedly until it attains very smooth grain surface and bright gloss. The rice thus finished can be boiled or steamed immediately without prior washing with water.

Ordinarily, milling brown rice to a pearling ratio of about 6% and onward will reduce the protein on the grain surface and gradually expose the starchy, hard inner portion. This makes efficient pearling by the non-humidifying process increasingly difficult. If humidification is effected at a pearling ratio of less than 6%, on the other hand, the proteinous bran will adhere to and soil the grain surface. Also, adding water in a too early stage must be avoided because premature humidification will allow the moisture to permeate into the inner structure of the rice grains and thereby cause crackling.

For the reasons stated above, the present invention is directed to pearling of rice in frictional pearling chambers where the rice grains are stripped of their bran layer principally by friction among themselves and then are smoothened on the surface, characterized in that the grains are humidified after they have been pearled to such an extent that they begin to unveil their starchy portions or after they have been processed to a pearling ratio of 6% or more to attain an even surface, so that the grain surface is softened to help increase the pearling efficiency and a fine, glossy white rice with a smoothly finished grain surface is obtained.

It should be noted that the rice may be humidified, when desired, even before the arrival at the pearling ratio of about 6%; it is not an absolute requirement to avoid the humidification until the rice is pearled to that degree.

Since the invention necessitates smooth finishing of the grain surface of rice, the pearling chambers to be used therefore are, in principle, of the friction type in which friction plays a major role in the pearling operation. Accordingly, the perforated wall surface areas of the debranning-pearling cylinders to be compared for proportioning in conformity with the invention are those of the frictional pearling chambers alone.

The grinding type chambers that depend primarily on the grinding action for pearling have a high safety factor against the breakage of rice but tend to roughen the grain surface with little possibility of smoothening. For this reason they cannot meet the requirements of the invention. Even where such a grinding type chamber may be employed as a part of the pearling apparatus of the invention, the perforated wall surface area of its debranning-pearling cylinder, which is of no use in smoothening the rice grain surface, should be disregarded in calculating the total wall surface area of the pearling cylinders in compliance with the invention.

Proportioning the perforated wall surface areas of frictional debranning-pearling cylinders is the most essential of the requirements according to the invention. Especially, it is imperative to ensure thorough debranning so that the rice grains may be completely polished after the humidification. Experiments indicate that the aforesaid and other objects of the invention are realized only when the quotient of the total surface area of the perforated debranning-pearling cylinders in the post-humidification stage divided by the product of the pearling ratio multiplied by the rice flow rate is more than one time as much as the quotient of the total surface area of the perforated debranning-pearling cylinders in the pre-humidification stage divided by the same product as above.

This ratio will now be explained in some more detail. Turning back to the early part hereof giving the definition of the terms such as pearling ratio, it has been stated that, if the total surface area in the post-humidification stage is 200 as against the total surface area in the pre-humidification stage which is 300, then the quotient of the total surface area of the perforated wall in the post-humidification stage divided by the said product is 0.543, whereas that in the pre-humidification stage divided by the said product is 0.515. Therefore, the former is 1.05 times as much as the latter, and the ratio of more than one-fold gives good result.

If the surface area proportions are 100 for the post-humidification stage as against 200 for the pre-humidification stage instead of the 200 as against 300 above described, the result will be somewhat unsatisfactory because the quotient of the total perforated wall surface area divided by the said product is 0.271 for the post-humidification stage as compared with 0.344 for the pre-humidification stage, thus giving a ratio of $0.271 \div 1.344 = 0.79$.

Under the invention, the perforated wall surface areas of frictional pearling chambers are proportioned according to the ratio above formulated so as to accomplish wet pearling of rice in a most effective and appropriate way and give smooth, glossy pearled rice which need no water washing before cooking.

The present invention will be better understood from the following description of a preferred embodiment thereof when taken in connection with the accompanying drawings, wherein.

Figure 1:
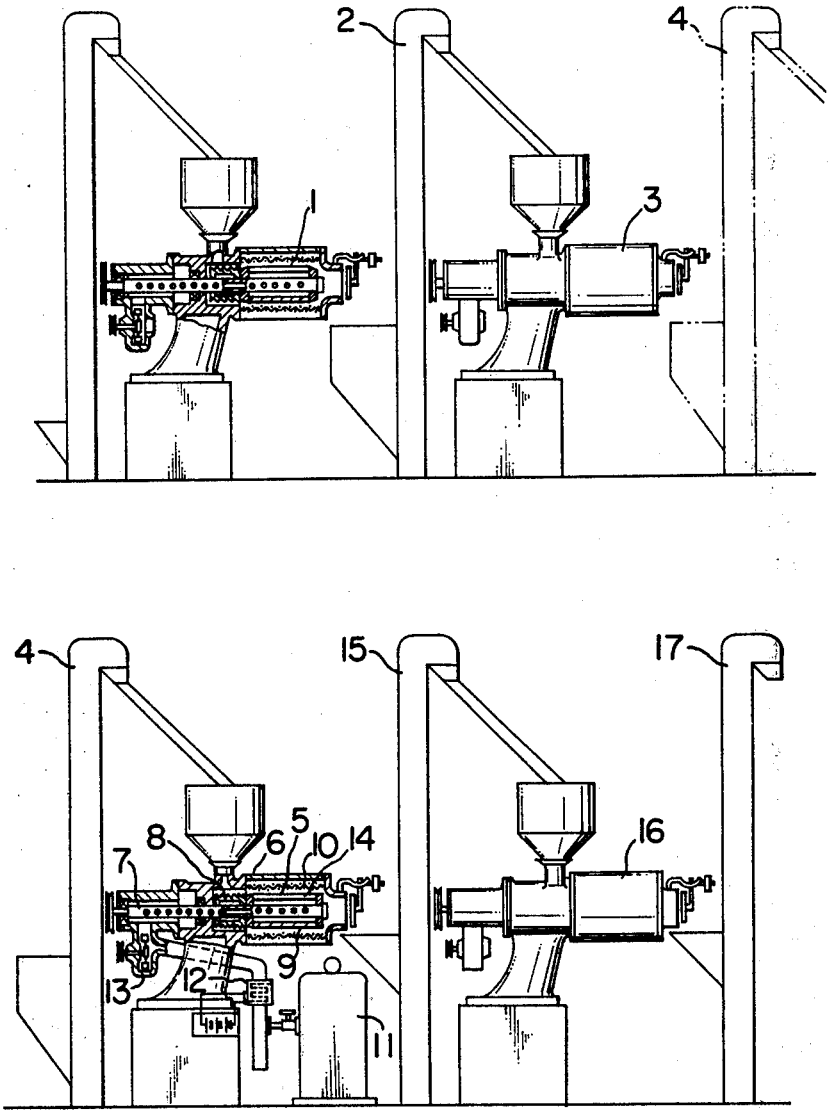
FIG. 1 is a side elevational view of an embodiment of the invention.
Figure 2:
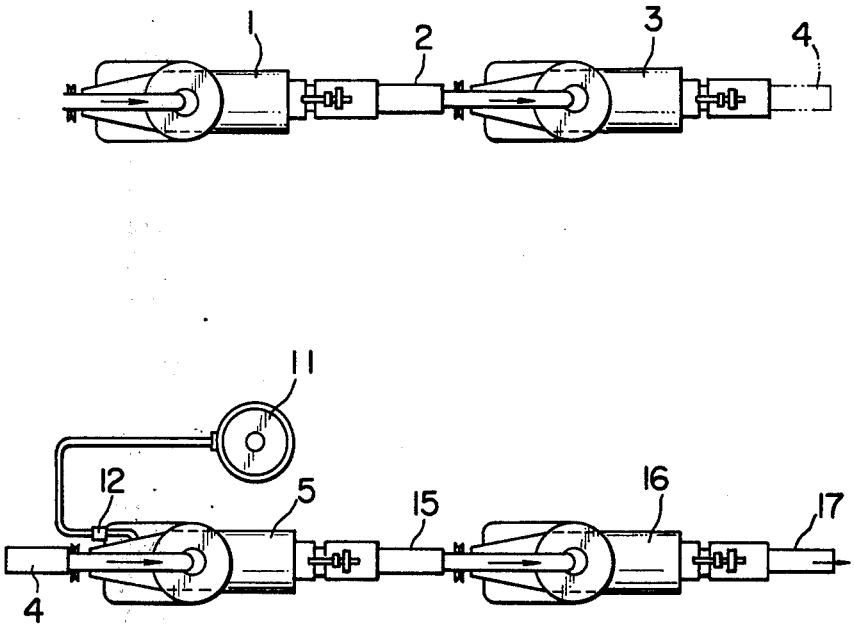
FIG. 2 is a top plan view of the embodiment.

Referring to the drawings there is shown a series of rice pearling units arranged in such a manner that a first pearling chamber 1 is communicated with a second pearling chamber 3 by a rice elevator 2. The rice discharged from the chamber 3 is transferred by another rice elevator 4 to a third pearling chamber 5. The rice pearling unit that includes the chamber 5 is built, for example, as follows. Inside the housing 6 a hollow main shaft 7 is rotatably journaled, and a rice feed roll 8 and a frictional pearling roll 9 are mounted together on the shaft 7. A perforated debranning-pearling cylinder 10 is secured to the inner wall of the housing, surrounding the frictional pearling roll 9. Beneath the housing there are installed a boiler 11, a heater 12, and a blower 13. The rice from the rice elevator 4 is conveyed by the rice feed roll 8 into the pearling chamber 5 formed between the perforated debranning-pearling cylinder 10 and the frictional pearling roll 9. At the same time, the steam generated by the boiler 11 is heated by the heater 12, and is drawn by suction and forced by the blower 13 into the hollows of the shaft 7 and of the frictional pearling roll 9 and thence, through orifices 14 formed in the wall of the roll 9, into the pearling chamber 5, where it humidifies the rice grains. The rice pearling chamber 5 is communicated with the pearling chamber 16 of the next unit by another rice elevator 15. In these chambers 5 and 16 the rice is subjected to humidifying, pearling, debranning, dehydrating, and polishing actions. The finished rice from the last pearling chamber 16 is transferred by a rice elevator 17 to a subsequent processing station not shown.

The rice pearling units having the chambers 1, 3 and 16 are of the same construction as the unit with the chamber 5, except that they do not include the boiler 11 and the heater 12 of the latter but are designed to give jets of air, instead of steam, by a blower into the pearling chamber. Hence a detailed description of their construction is omitted.

Various modifications in the disclosed embodiments of the invention may be made by one skilled in the art without departing from the scope of the invention as defined by the claims.

What is claimed is:

1. An apparatus for pearling rice comprising:

a plurality of frictional rice pearling units, each unit including a perforated pearling cylinder;

means for feeding rice successively to each of the pearling units, the pearling units in series communication such that the output of one pearling unit is the input to an adjacent pearling unit; and means for introducing a humidifying agent into a selected one of the plurality of pearling units at a location where a first quotient of the total surface area of the pearling cylinder divided by the product of the pearling ratio multiplied by the flow rate of rice after the introduction of the humidifying agent is not less than a second quotient of the total surface area of the pearling cylinder divided by the product of the pearling ratio multiplied by the flow rate of rice before the introduction of the humidifying agent and the pearling ratio is defined as the ratio of the weight of rice lost on pearling to the original weight of the rice.

2. An apparatus according to claim 1 wherein the humidifying agent is an aqueous solution or humidified air or steam.

3. An apparatus according to claim 1 wherein the humidifying introduction means comprises a source of water vapor and means for supplying the water vapor to the selected pearling unit.

4. An apparatus according to claim 1 wherein the cylinder surrounds a pearling roll to form therebetween a pearling chamber and the humidifying agent is introduced into the pearling chamber.

5. An apparatus according to claim 1 wherein the first quotient is substantially equal to the second quotient.

6. An apparatus according to claim 1 wherein the first quotient is not less than one time as much as the second quotient.

* * * * *